US010039432B2

(12) United States Patent
Bisson

(10) Patent No.: US 10,039,432 B2
(45) Date of Patent: Aug. 7, 2018

(54) PORTABLE APPARATUS HAVING EXTENDIBLE WAND ATTACHMENTS

(71) Applicant: Montgomery Bisson, Huntington Beach, CA (US)

(72) Inventor: Montgomery Bisson, Huntington Beach, CA (US)

( * ) Notice: Subject to any disclaimer, the term of this patent is extended or adjusted under 35 U.S.C. 154(b) by 305 days.

(21) Appl. No.: 14/556,180

(22) Filed: Nov. 30, 2014

(65) Prior Publication Data

US 2016/0150926 A1 Jun. 2, 2016

(51) Int. Cl.
*A47L 11/40* (2006.01)
*A47L 11/34* (2006.01)

(52) U.S. Cl.
CPC ..... *A47L 11/4083* (2013.01); *A47L 11/34* (2013.01); *A47L 11/40* (2013.01)

(58) Field of Classification Search
CPC ..... A47L 11/34; A47L 11/4083; A47L 11/40; A47L 9/0036; A47L 7/0023; A47L 9/244; A47L 9/248
See application file for complete search history.

(56) References Cited

U.S. PATENT DOCUMENTS 3,509,590 A * 5/1970 Hideya ..... A47L 5/365 15/323
5,299,767 A * 4/1994 Simpson ..... B05B 15/00 239/175
5,331,714 A * 7/1994 Essex ..... A47L 9/0036 15/323
6,260,233 B1 * 7/2001 Wareham ..... A47L 9/0009 15/323
6,510,582 B1 * 1/2003 Yoo ..... A47L 9/0009 15/323
6,945,261 B2 * 9/2005 Wadsworth ..... A61L 2/18 134/174

* cited by examiner

*Primary Examiner* — Robert Scruggs
(74) *Attorney, Agent, or Firm* — Paul Adams

(57) ABSTRACT

A portable apparatus including a hose and wand and an attachment device for storing the hose in a coiled condition and for supporting the wand in a vertical position above the surface on which the apparatus rests.

19 Claims, 12 Drawing Sheets

PORTABLE APPARATUS HAVING EXTENDIBLE WAND ATTACHMENTS

TECHNICAL FIELD OF THE INVENTION

The field of the present invention relates to portable apparatus that include a hose and wand useable, for example, as a cleaning apparatus, but having other potential uses wherein the apparatus hose and wand must be extended during use but is desirably stored on the apparatus to facilitate movement of the apparatus from one location to another.

BACKGROUND OF THE INVENTION

In the carpet cleaning art, particularly, but not exclusively, for commercial buildings such as offices, retail stores, and industrial facilities large carpeted areas, tile, stone, concrete or other areas not adversely affected by water are cleaned by applying a liquid cleaning solution to the carpet or other areas to loosen and remove dirt, foreign particles and stains. The solution is subsequently removed by applying a vacuum. In the industry the device is referred to as an extractor. The extractor includes a housing or body that is moveable on wheels and in which there may be a clean solution tank or reservoir from which solution may be sprayed onto the soiled carpet or hard floor. The housing also includes a dirty or recovered cleaning solution tank or reservoir to receive the dirty cleaning solution from the carpeting to facilitate the drying of the carpeting and removal of the dirt and other soil loosened by the cleaning solution, optionally after agitation of the sprayed carpeting. The housing also includes a power source such as a motor that operates a fan that creates a vacuum in a chamber.

Many extractors have a suction head integrally attached to the body or housing of the extractor. Other extractors may include a hand held wand with a suction head at one end to be applied to the carpeting and attached at the other or handle end to a flexible hose that is attached to the vacuum source or chamber that the operator uses to remove the dirty solution and to collect it in a dirty cleaning solution tank. To provide flexibility in use, the hose is elongated thus permitting free movement of the wand and suction head by the operator over a substantial area of the floor without constantly moving the entire apparatus. Clean solution may be applied through a second hose also attached to the handle end of the wand at one end and to the clean solution tank at the other end. Alternatively, the clean solution may be applied with other equipment prior to the extraction process. The wand includes an elongated member attached to the second hose, the wand having a trigger at the upper end to control the dispensing of the clean solution.

A common problem in the prior art extractor apparatus art where the extractor includes a hose and a wand, is properly storing the hose and wand when not in use. Typically, there is no provision in the prior art for conveniently supporting the wound hose when not in use so that it may be carried by the housing rather than a user. Similarly, typical prior art extractor apparatus have no provision for holding an elongated wand on the apparatus so that it may be carried by the apparatus rather than the user when the apparatus is not in use. These problems are solved by the present invention as well as other deficiencies of prior art apparatus that are also solved with the present invention.

Other applications of the apparatus may include wet-dry vacuums, self-contained vacuums, ride-on scrubbers or other wheeled, portable devices that include a hose and a wand.

SUMMARY OF THE INVENTION

In a portable apparatus having a housing, an elongated, flexible hose, and a hand held wand connected to one end of the hose, the other end of the hose connected to the housing, a storage system for the hose and wand comprising an upper attachment and hose supporting device mounted on the housing and extendible from a first stored position to a second extended, operative position, the upper storage system includes a hose supporting member on which the hose may be hung when the upper device is in an extended position such that the hose, in a coiled or wound condition, is conveniently stored, the upper attachment device also including a wand detachable grasping member connected to the hose supporting member for supporting the wand in a vertical orientation and a lower attachment device mounted on the housing and extendible from a first stored position to a second extended, operative position, the lower attachment device including a wand detachable grasping member for supporting the wand in a vertical orientation.

DETAILED DESCRIPTION OF ONE EMBODIMENT OF THE INVENTION

Figure 1:
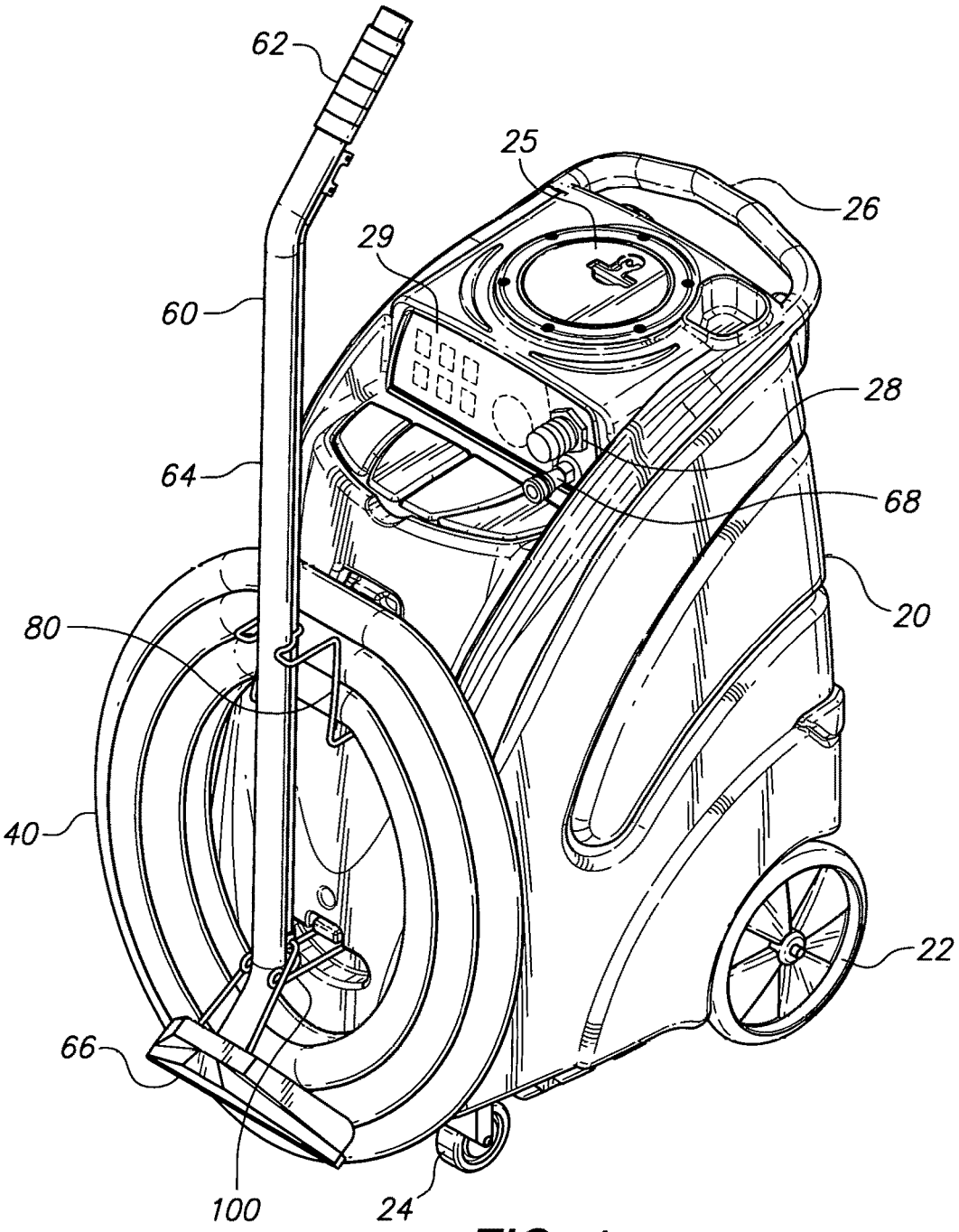
FIG. 1 is a perspective view of a floor cleaning extractor showing a hose and wand in stored position.
Figure 2:
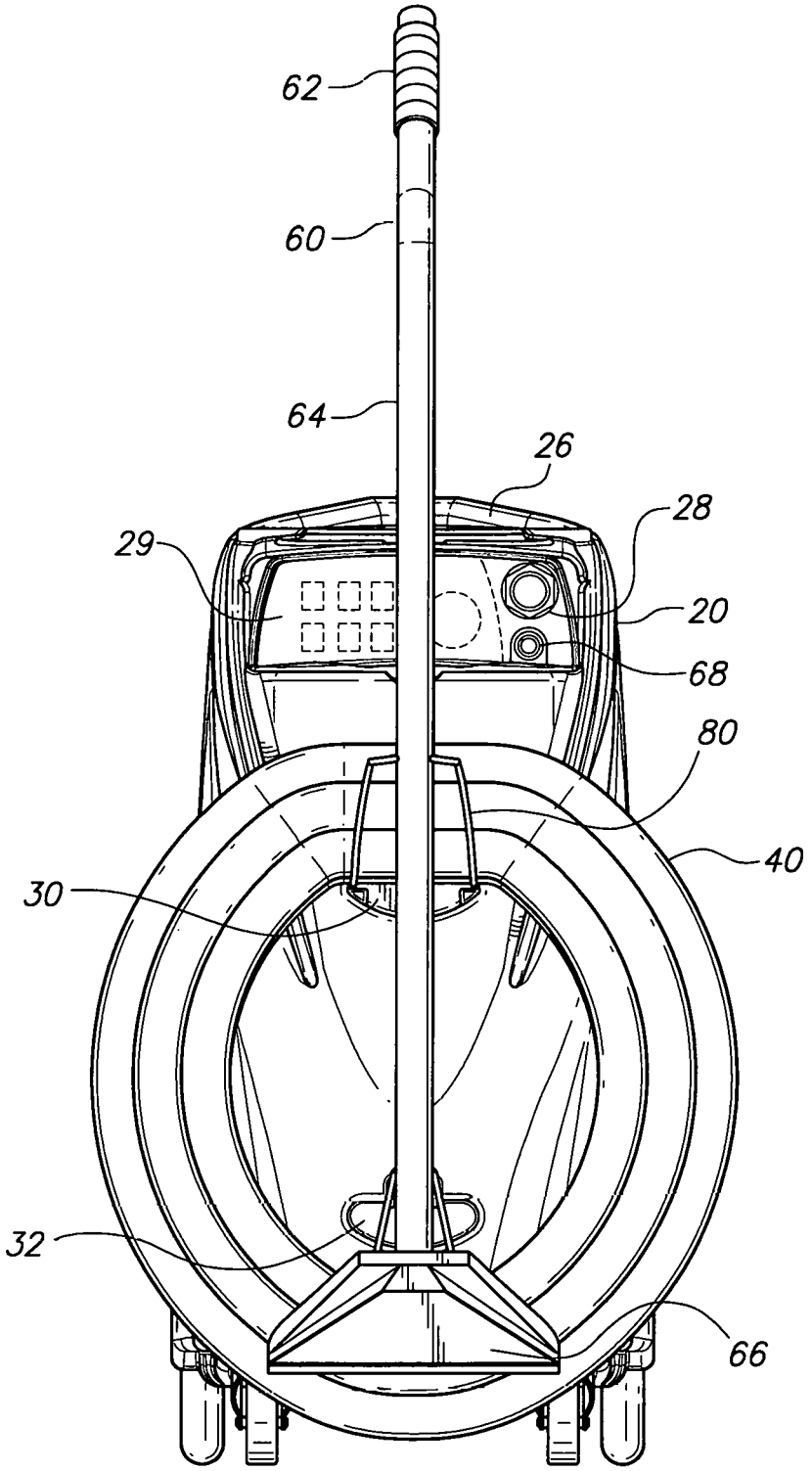
FIG. 2 is a front view of the design as shown in FIG. 1.
Figure 3:
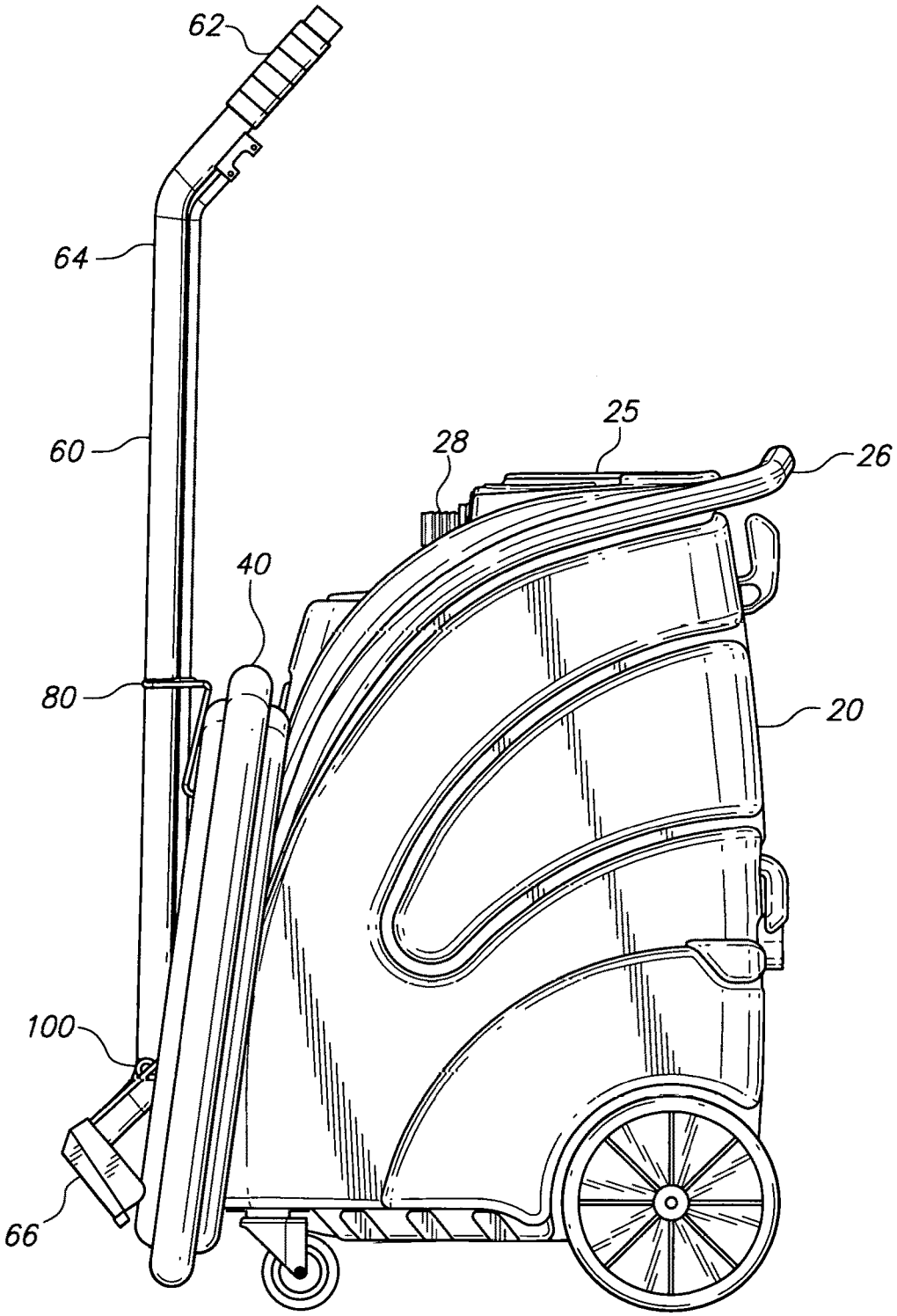
FIG. 3 is a left side view of the design as shown in FIG. 1.
Figure 4:
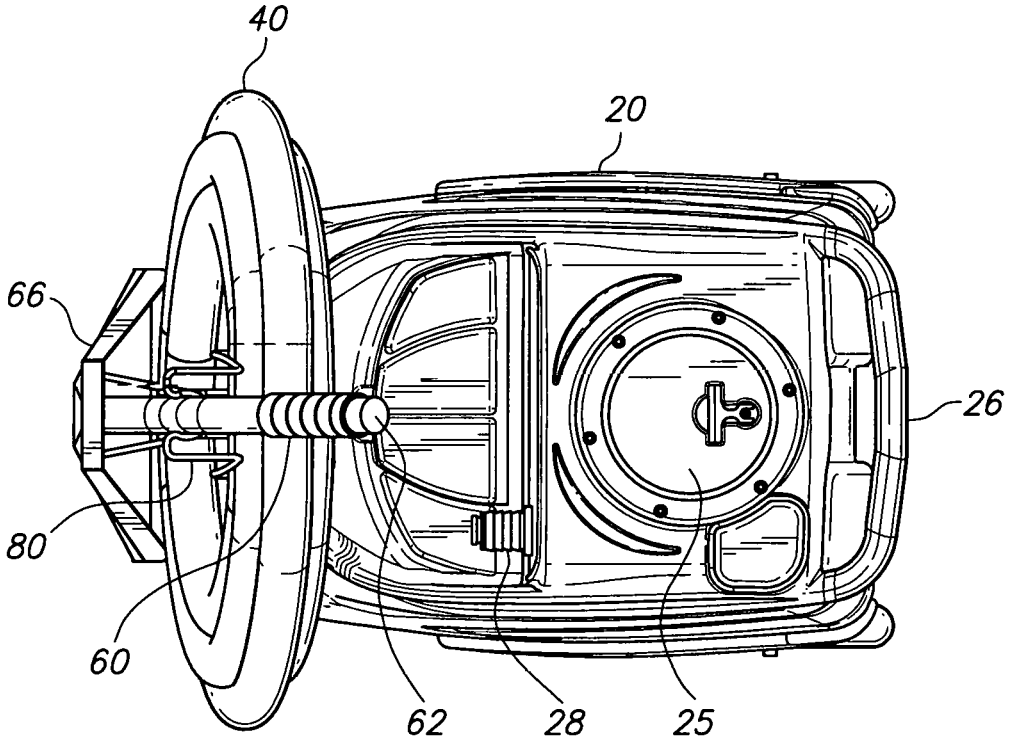
FIG. 4 is a top view of the design as shown in FIG. 1.
Figure 5:
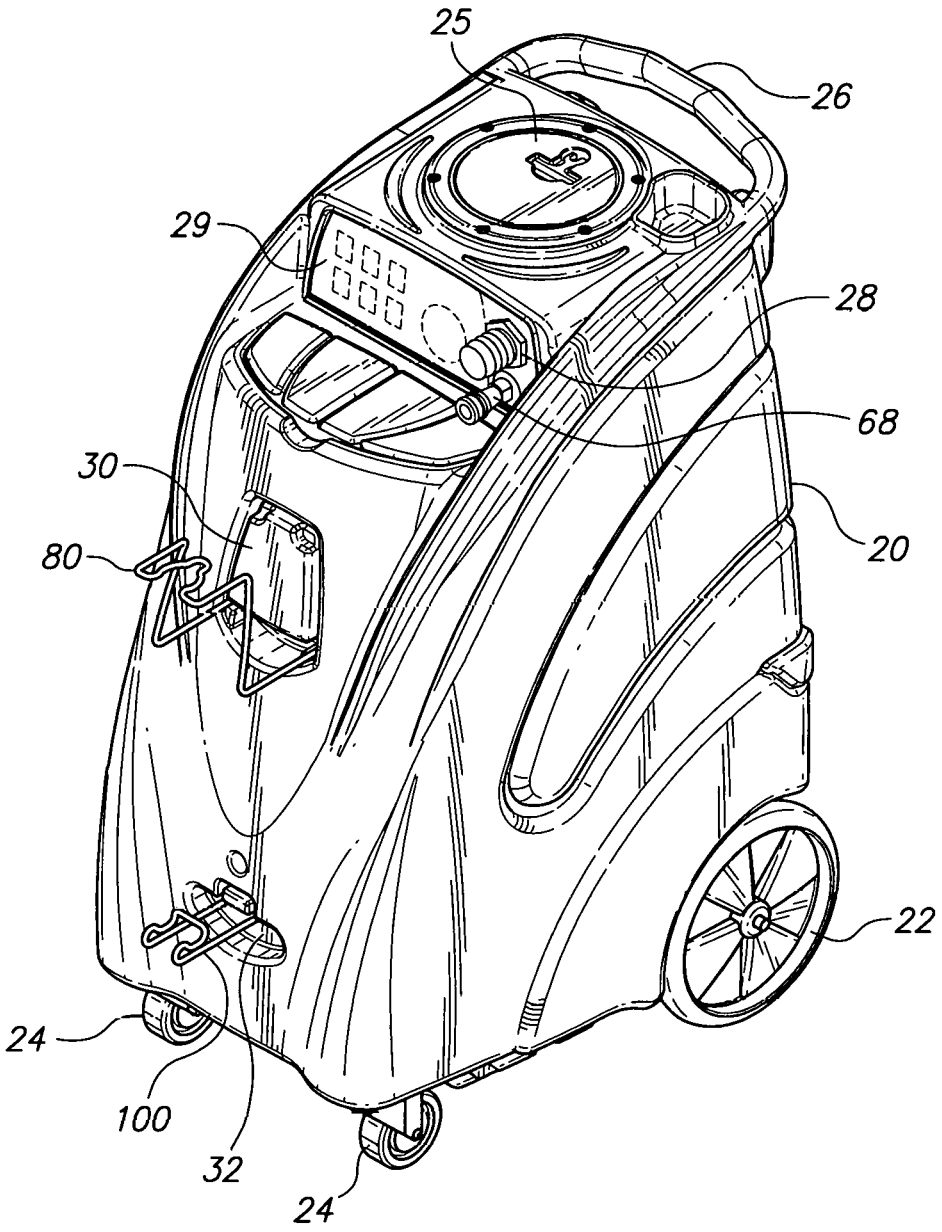
FIG. 5 is a perspective view of the floor cleaning extractor showing the hose and wand attachment clips in an extended position.
Figure 6:
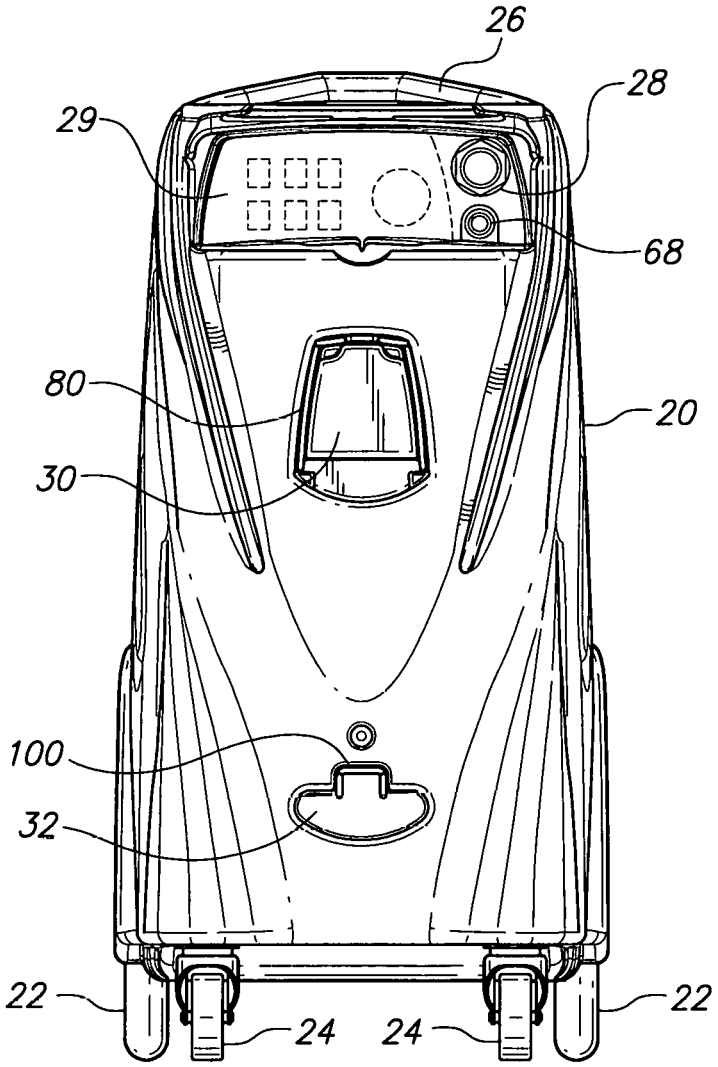
FIG. 6 is a front elevation view of the design as shown in FIG. 5.
Figure 7:
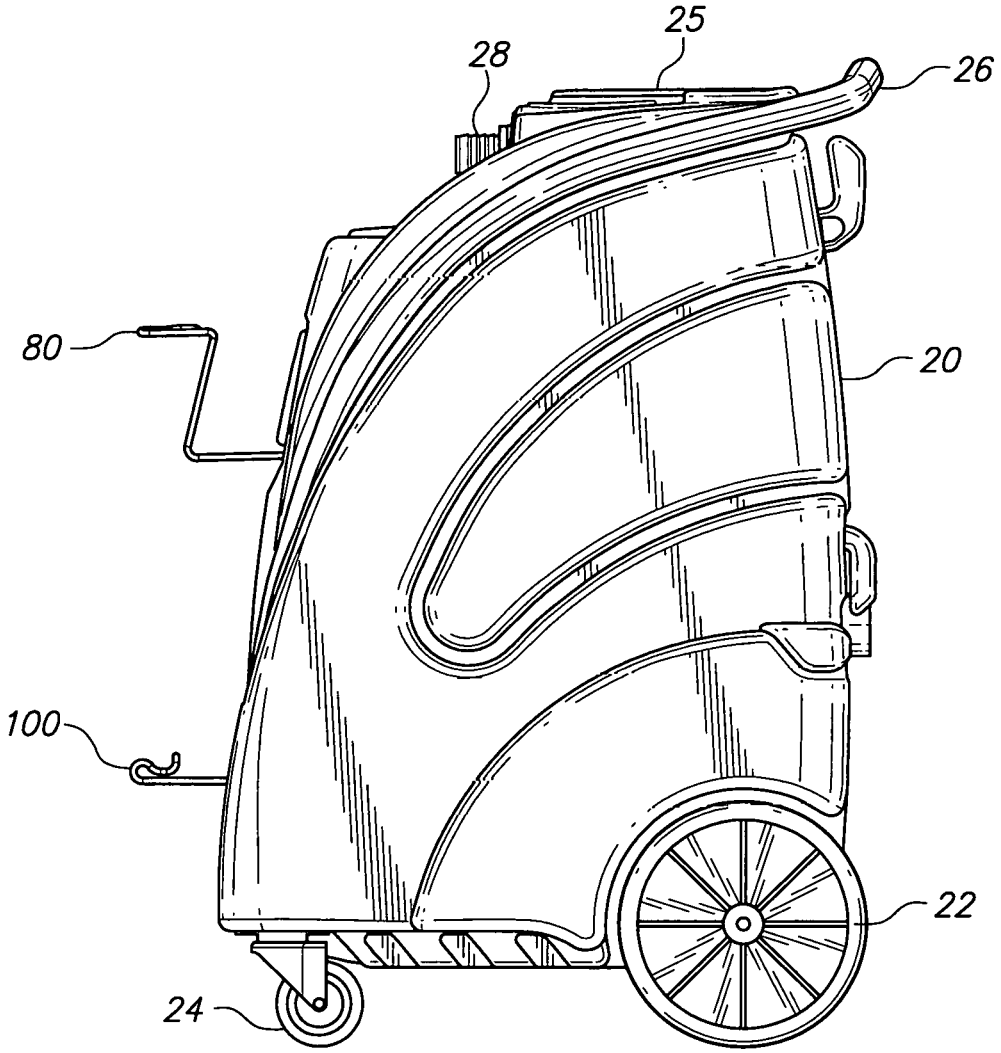
FIG. 7 is a left side view of the design as sown in FIG. 5.
Figure 8:
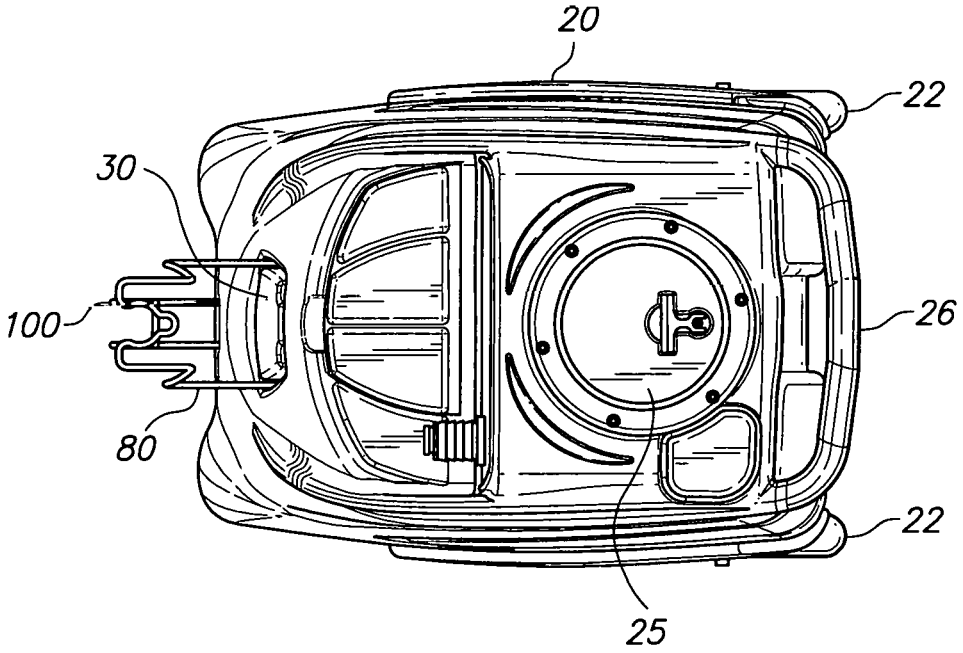
FIG. 8 is a top view of the design as shown in FIG. 5.

The embodiment of the invention shown in FIG. 1 is a floor cleaning extractor, that is, a portable apparatus including a body or housing 20, a flexible hose 40, a wand 60, an upper wand-hose attachment device 80, and a lower wand attachment device 100. The body includes rear wheels 22 and front wheels 24. Within the body is a motor and fan assembly (not shown) for creating a vacuum chamber to produce suction to withdraw or extract cleaning solution that has been applied to carpeting or hard floors. The motor and suction assembly is well known in the art. The body also includes a tank or reservoir (not shown) having a fill opening and cover 25 for receiving clean or fresh cleaning solution that is applied to the carpeting. The body 20 also includes a chamber or reservoir (not shown) for the dirty solution withdrawn from the carpeting; the reservoir is attached to a drain from which the dirty solution may be periodically emptied. The body includes a handle 26 for the user to move and relocate the apparatus as the cleaning process continues. The body has an electric plug for a cord to supply the apparatus motor with power although batteries may be used as a power source. It also includes a hose connection 28 for attachment of the hose 40. An operator panel 29 includes various controls such as the OFF-ON power switch, pump and pump primer control, full-tank indicator light, and dual-circuit indicator light.

Figure 9:
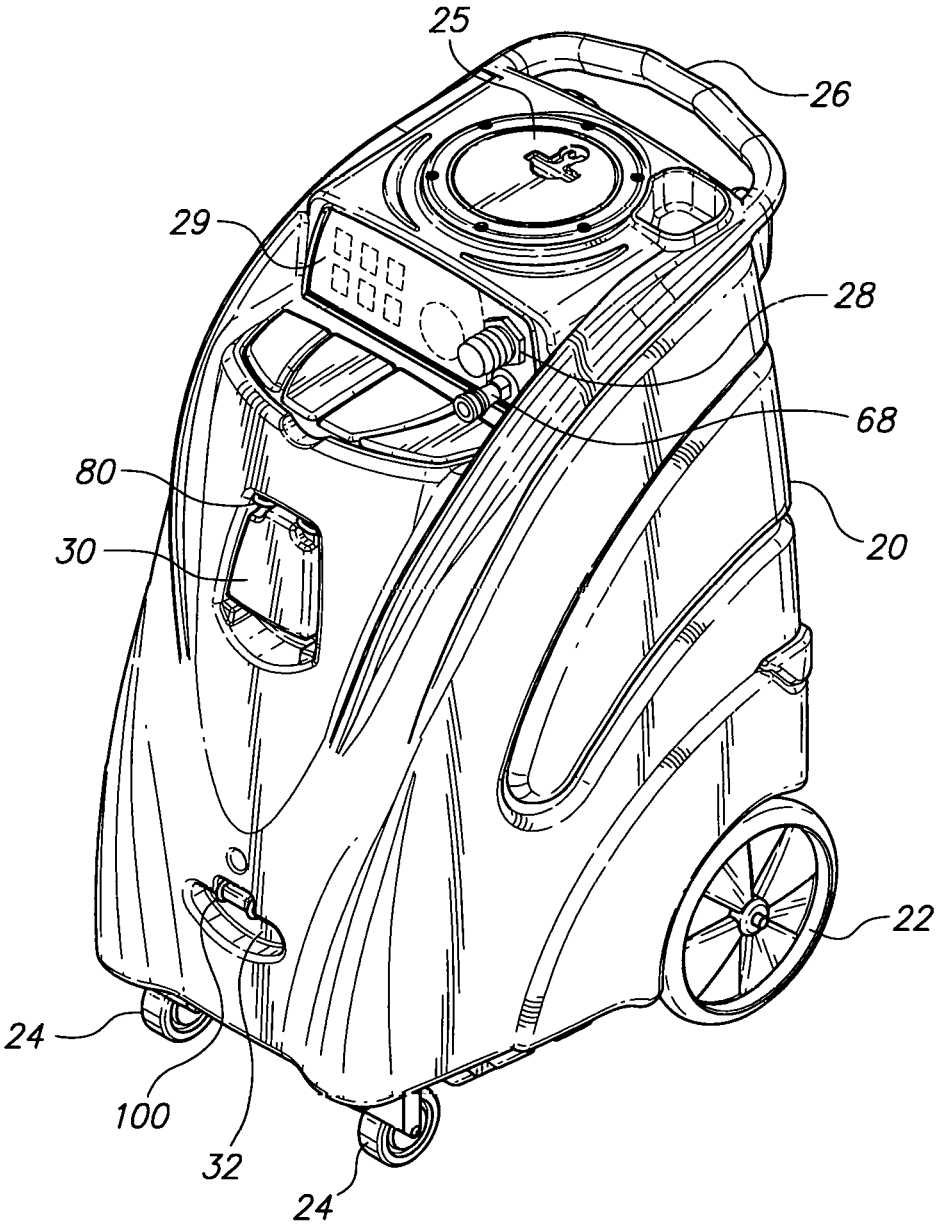
FIG. 9 is a perspective view of the floor cleaning extractor showing the hose and wand attachment clips in a retracted position.
Figure 10:
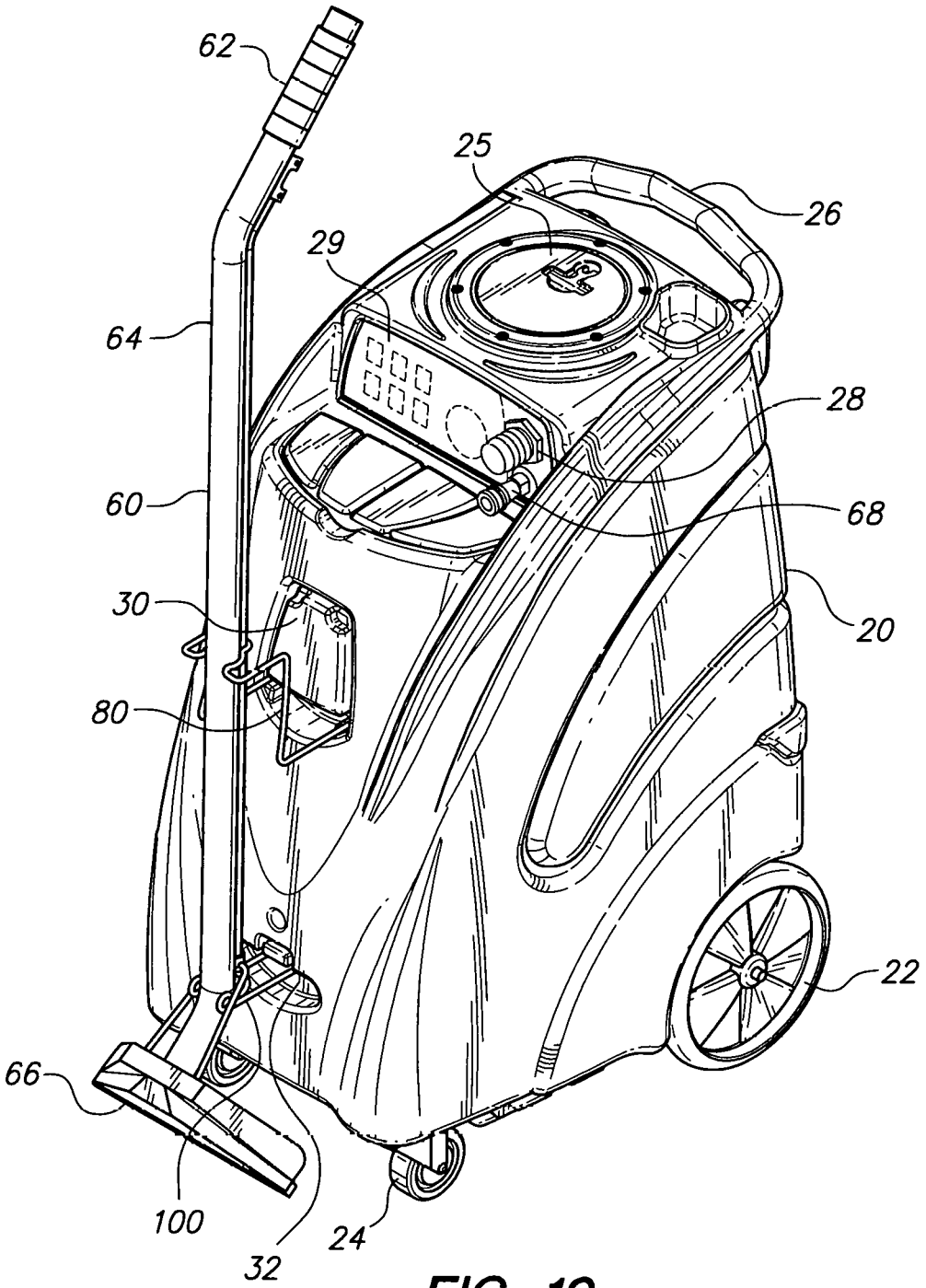
FIG. 10 is a perspective view of the floor cleaning extractor showing the wand held by the extended clips.

Mounted on the front of the body is a storage system for the hose 40 and the wand 60 comprising the upper attachment device 80 and the lower attachment device 100. The attachment devices in the instant embodiment comprise clip assemblies shown in the extended position as seen best in FIGS. 1, 5, 7, 8 and 10 and in the retracted position in FIG. 9. As seen in FIG. 10, the wand 60 is shown attached by the upper and lower attachment assemblies, 80 and 100 in a substantially vertical position with the wand 60 positioned such that it is not touching or in contact with the carpet or floor. This is the position in which the wand is stored as when the apparatus is not in use and/or may be moved from one location to another.

While the wand is shown attached to the body in FIG. 10 without the hose 40, that is atypical since the hose, in a coiled or wound condition, is also stored by support on the upper attachment assembly 80 as shown in FIGS. 1 through 4 together with the wand 60, but obviously the wand could be attached and not the hose as the user may desire. As shown in FIGS. 5, 6 9 and 10, the front of the body 20 includes recessed portions 30 and 32, for receiving the attachment assemblies 80 and 100, respectively, when retracted so as to be flush or recessed and less likely to be inadvertently damaged as the apparatus is moved or is in use with other equipment and workers.

The hose 40 is a flexible tube that may be formed from a variety of materials, such as rubber or plastic, as is well-known in the art. The hose is connected at one end to the hose inlet 28 on the front of the apparatus body as shown in FIG. 1 and to the dirty cleaning tank; it may be attached at its the free end to the upper end, or handle, 62 of wand 60. The hose is sufficiently flexible to allow the operator freedom of movement of the wand as is necessary during the extraction and/or application operation and may be coiled and hung or supported by the upper attachment assembly 80 so that it is conveniently stored and securely supported during movement of the apparatus.

The wand 60 includes a handle 62 that connects to the free end of the hose 40 and comprises an elongated hollow tube 64 of stiff material such as plastic or metal as is well-known in the art. At the lower end of the wand 64 is a suction head 66 that contacts the floor during operation of the apparatus.

In the embodiment shown, the apparatus holds and delivers clean solution from the reservoir (not shown) through a fluid connector 68 mounted on the front of the body 20 and through a flexible tube (not shown) that connects to the wand that includes a hollow rod 70 and a trigger 72 at the upper end of the wand to dispense the clean solution.

The "attachment assemblies" are to be understood as temporary attachment devices for holding the wand and supporting the coiled hose when the apparatus is not in use. More precisely they may be denominated as temporary attachment and supporting devices. For convenience, the attachment assemblies may also be referred to as clip assemblies or simply clips as shown in the embodiment of the invention illustrated and described.

The lower attachment device or clip assembly 100 is fabricated from steel or other material that is sufficiently resilient to permit momentary deflection under manual force to permit the lower portion of the wand 60 to be inserted and grasped and held by the clip assembly. The clip assembly as illustrated is formed from spring steel wire and has a circular cross-section although it will be understood that other cross-sections may be used. The lower and upper attachment devices 100 and 80 may be shaped or configured in a variety of ways to permit the attachment and detachment to be performed in a quick but positive way to assure that the wand is properly secured and additionally to support a variety of tools and various shaped cleaning wands and hoses. Moreover, as described above, it is desirable that the clip may be extended and retracted into the lower body cavity or opening.

Figure 11:
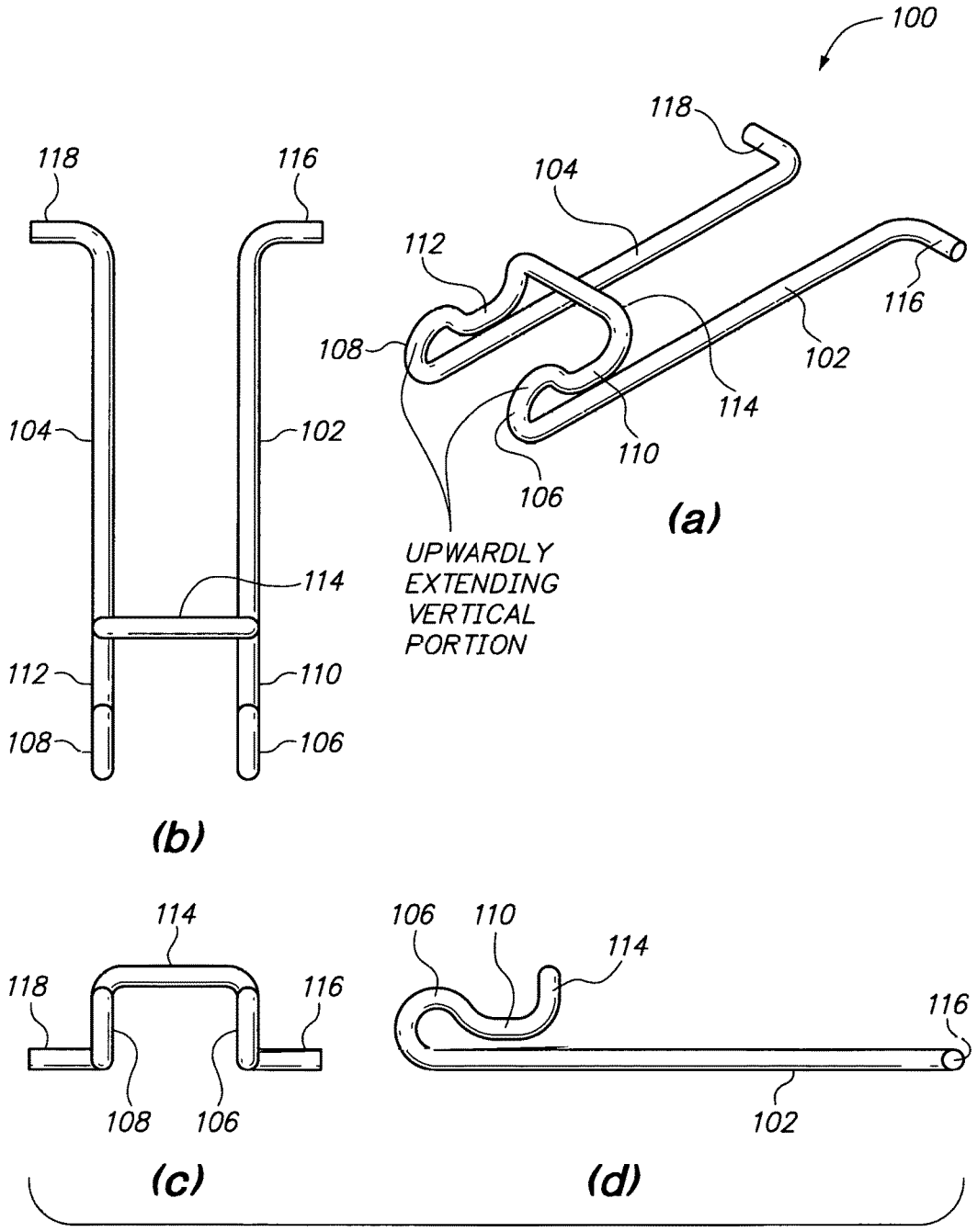
FIG. 11 shows four views, (a), (b), (c), and (d), of the lower hose and wand attachment clip.

The lower clip assembly 100, shown in perspective in FIG. 11(*a*) comprises a pair of elongated arms 102, 104, vertically and convexly curved sections 106, 108, and horizontally reversed curved sections 110, 112, i.e. the sections 110, 112 being concave in the vertical plane, and a horizontal section 114 that permanently attaches the sections 102, 106, and 110 to sections 104, 108, and 112. As shown, the entire clip is formed from a single wire member although it will be understood that it may be fabricated from separate sections. As indicated, the material must be resilient so that the sections 102, 106 and 110 are biased toward sections 104, 108, and 112. The horizontal or transverse section 114, that also acts to secure the wand and spinning pressure cleaning tools in a direction orthogonal to the front of the body, and permits the momentary movement of two sections to be deflected and then recovered so as to firmly grasp the wand lower portion. At the free ends of arms 102 and 104, there are formed stop sections 116 and 118 bent in the horizontal plane so as to prevent the arms and the entire clip from detachment from the body recess 32. The arms 102 and 104 may have a length that positions the grasping section, that is, sections 106, 108, 110, 112 and 114 vertically below the comparable grasping section of the upper clip assembly 80.

Figure 12:
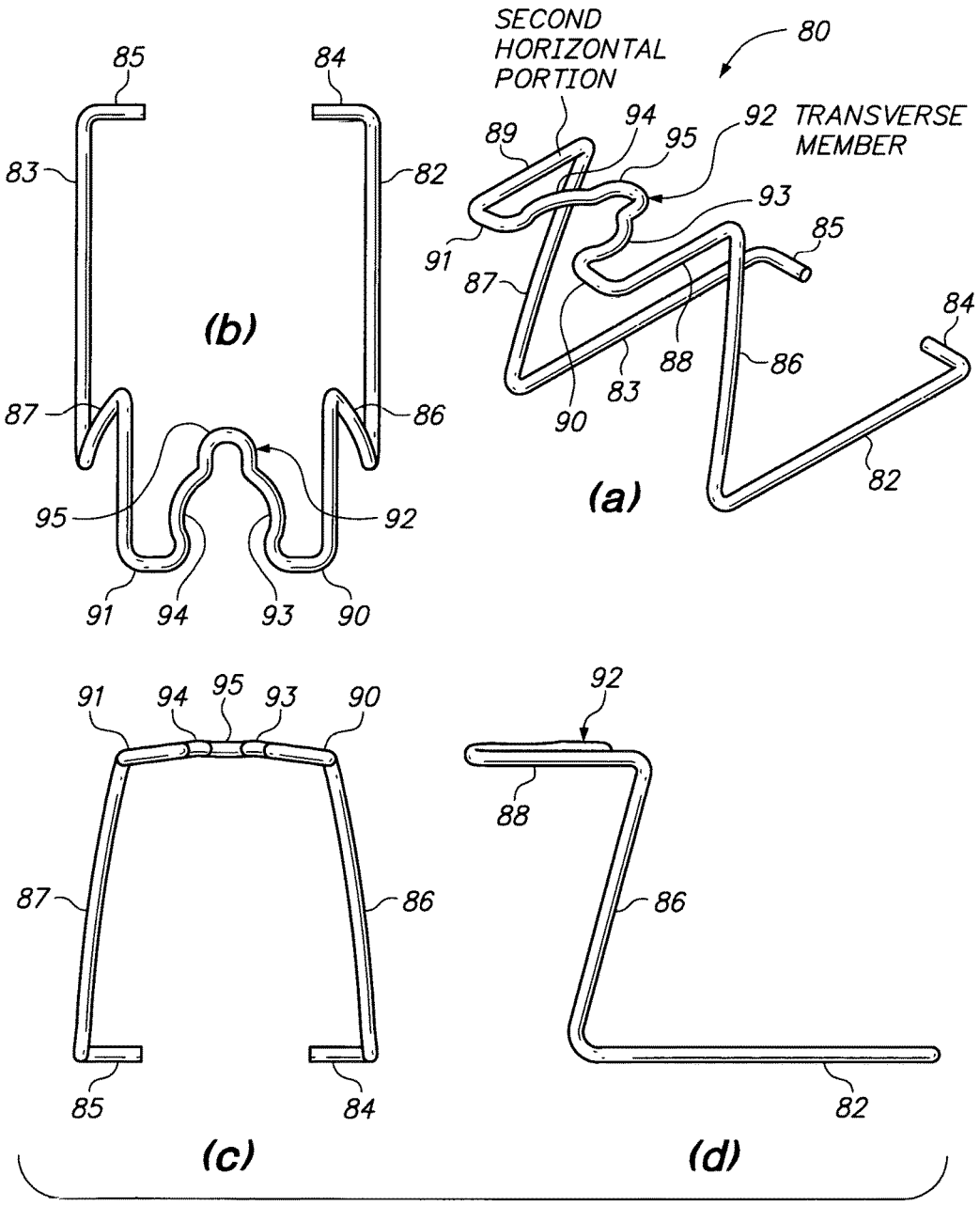
FIG. 12 shows four views, (a), (b), (c), and (d), of the upper hose and attachment clip.

The upper attachment device or clip assembly 80, shown in perspective in FIG. 12(*a*), comprises two horizontal arm members 82, 83, that may be stiff or relatively rigid, having stop sections 84, 85 to prevent the clip from being detached from the body. At the free end of the arms 82, 83 there are substantially vertical members 85, 86, attached at their upper ends to horizontal sections 88, 89 that project away from the body 20. The ends of the horizontal sections 88, 89 are attached to short horizontal sections 90, 91 that project toward one another. The ends of short horizontal sections 90, 91 are attached to curved transverse member 92 comprising opposing circular sections 93, 94 and a small circular portion 95. In operation the wand 40 is inserted and grasped between the circular sections 93, 94 by forcing those sections apart so as to receive the wand that has a diameter larger than the distance between the two opposing circular sections 93, 94 and upon recovery firmly grasps the wand and holds it in the vertical position during storage or movement of the apparatus. The rod 70 fits into the small circular section 95. The upper attachment device 80 is positioned directly above the lower attachment device 100 such that when the wand tube 64 is stored, it is in a substantially vertical position with the suction head 66 spaced above the floor on which the apparatus rests.

From the above descriptions and drawings it will be seen that the embodiment of the invention provides a storage system for a portable apparatus that conveniently supports a hose in a wound condition and also securely grasps and hold a wand at upper and lower attachments assemblies for facilitating the movement of the apparatus when not in use by carrying the hose and wand. While the invention has been described with reference to the embodiment, modifications and alterations will occur to those skilled in the art upon reading and perceiving the invention as described and shown. It is intended that the appended claims cover all of such modifications and alterations and equivalents thereof.

I claim:

1. In a portable apparatus for cleaning floors comprising a housing, a flexible elongated hose connected to a tank in the housing and terminating in a wand, a storage mechanism for the wand and hose comprising:

an upper attachment device mounted on said housing and extendible from a first stored position to a second operative position, the upper attachment device including a horizontal portion and an upwardly extending vertical portion connected to said horizontal portion, and a second horizontal portion connected to said vertical portion including a pair of resilient generally parallel members biased toward one another for clampingly receiving the upper section of the wand in a substantially vertical position, said resilient members connected by a transverse member; and a lower attachment device mounted below said upper attachment device on the housing and extendible from a first stored position to a second operative position, the lower attachment device including a horizontal portion, an upwardly extending vertical portion and a second horizontal portion including a pair of generally parallel resilient members for clampingly receiving the lower section of the wand in a substantially vertical position, said resilient members connected by a transverse member;

whereby when said first and second attachment devices are in the operative position, the hose may be wound around the horizontal portion of said upper device for storage, and said generally parallel resilient members of said first and second devices support the wand such that the lower end is above the floor level.

2. The portable apparatus for cleaning floors of claim 1 wherein the wand is a hollow plastic tube having one end connected to the hose and a transversely extending hollow floor contact member connected at the opposite end.

3. The portable apparatus for cleaning floors of claim 1 wherein the flexible elongated hose is connected to a vacuum chamber within the housing at one end and to the wand at the opposite end.

4. The portable apparatus for cleaning floors of claim 1 wherein the upper attachment device comprises a wire assembly including:

a pair of straight stiff wires horizontally oriented and mounted at one end in the housing through openings in the housing wall;

a pair of straight wires vertically oriented and attached at the lower ends to the free ends of said horizontally mounted stiff wires;

a second pair of straight wires horizontally oriented and attached to the upper ends of the two vertically oriented wires; and a transverse wire member having a curved section with a diameter less than the diameter of the wand hollow tube connected to the second horizontally oriented wire pair at the free ends thereof;

whereby said curved section of the transverse member clampingly engages the wand tube when in a vertically stored position.

5. The portable apparatus for cleaning floors of claim 4 wherein said wire assembly is a single integral piece of wire.

6. The portable apparatus for cleaning floors of claim 1 wherein said lower attachment device comprises a lower wire assembly including:

a pair of straight wires horizontally oriented and mounted at one end in the housing through openings in the housing wall;

a pair of curved wires vertically oriented and attached at the ends to the free ends of said horizontally mounted wires; and a transverse wire member connected to the second horizontally oriented wire pair at the free ends thereof for receiving a lower portion of the wand tube when in the stored position.

7. The floor cleaning portable apparatus of claim 1 including a vacuum extractor for ingesting cleaning fluid that has been applied to the floor to facilitate extraction of the solution that has been applied to the floor.

8. In a portable apparatus including a body, an elongated hose, and a hand held wand connected to one end of the hose, the other end of the hose connected to the body, a storage system for the hose and wand comprising:

an upper attachment device mounted on the body and extendible from a first stored position to a second extended, operative position, said upper attachment device including a hose supporting member on which the hose may be hung when the upper device is in an extended position such that the hose, in a coiled or wound condition, is positioned for storage, the upper attachment device also including a wand detachable grasping member connected to the hose supporting member to hold the wand in a substantially vertical orientation; and a lower attachment device mounted on the body and extendible from a first stored position to a second extended, operative position, the lower attachment device including a wand detachable grasping member for supporting the wand in a vertical orientation.

9. The apparatus of claim 8 additionally including recesses in said body, each recess for receiving one of said attachment devices so as to position the devices in an out-of-the-way position.

10. The apparatus of claim 8 wherein each of said attachment devices are formed from a single piece of resilient material.

11. The apparatus of claim 10 wherein the material is spring steel.

12. The apparatus of claim 8 wherein the upper attachment device is positioned above the lower attachment device so as to store said wand in a generally vertically oriented position.

13. The apparatus of claim 8 wherein said hose is formed from flexible material.

14. The apparatus of claim 8 additionally including a reservoir for dirty cleaning solution, and a motor and fan assembly for creating a vacuum chamber attached to said hose whereby carpeting may be sprayed or saturated with fresh cleaning solution and said wand may be used to extract the solution from the carpeting and deposit it in said dirty solution reservoir from which it may later be discarded.

15. The apparatus of claim 14 wherein said body includes a second reservoir for fresh cleaning solution that may be applied to the carpeting using the wand.

16. The apparatus of claim 8 wherein said upper and lower attachment devices include arms that are biased toward one another so that they firmly grip the wand when they are temporarily force apart and then allowed to recover so as to apply a bias to the wand.

17. A portable apparatus for cleaning floors comprising:

a housing;

a flexible elongated hose connected to a tank in the housing;

a wand connected to the free end of said hose;

a storage system for the wand and hose comprising:

an upper attachment device mounted on said housing and extendible from a first stored position to a second operative position, said upper attachment device comprising a resilient integral wire member including a horizontal portion for supporting the hose when in the coiled or wound condition and a curved biasing portion clampingly receiving the upper section of said wand in a substantially vertical position; and a lower attachment device mounted below said upper attachment device on the housing and extendible from a first stored position to a second operative position, said lower attachment device comprising a resilient integral wire member including a curved biasing portion clampingly receiving the lower section of the wand in a substantially vertical position;

whereby when said first and second attachment devices are in the operative position, the hose may be wound around the horizontal portion of said upper wire member, and said curved upper and lower wire members support the wand such that the lower end is above the floor level to facilitate movement of said portable apparatus for cleaning floors.

18. The portable apparatus for cleaning floors of claim 17 wherein said wire member is formed of resilient steel.

19. The portable apparatus for cleaning floors of claim 17 wherein said housing includes a clean solution tank, a dirty solution tank, a motor and vacuum chamber, a second hose connected to said clean solution tank and at the other end to said wand, said wand including a trigger, whereby said wand may be used to spray clean solution on the floor for removing dirt and foreign material that may be subsequently extracted by vacuuming and returned to the dirty solution tank.

* * * * *